US005609500A

United States Patent [19]

Holmes et al.

[11] Patent Number: 5,609,500

[45] Date of Patent: Mar. 11, 1997

[54] ACCESSORY CONNECTOR ALIGNMENT AND SUPPORT PLATE

[75] Inventors: Martin E. Holmes, Hoffman Estates; Paige M. Painter, Bartlett, both of Ill.; Mark J. McGrath, Mt. Pleasant, Iowa

[73] Assignee: Motorola, Inc., Schaumburg, Ill.

[21] Appl. No.: 581,868

[22] Filed: Jan. 2, 1996

[51] Int. Cl.[6] ..... H01R 13/60

[52] U.S. Cl. ..... 439/540.1; 439/940

[58] Field of Search ..... 439/540.1, 541, 439/355, 541.5, 79, 80, 669, 940

[56] References Cited

U.S. PATENT DOCUMENTS

| | | | |
|---|---|---|---|
| 4,867,699 | 9/1989 | Oda et al. | 439/355 |
| 4,997,386 | 3/1991 | Kawachi et al. | 439/540.1 |
| 5,037,330 | 8/1991 | Fulponi et al. | 439/541.5 |
| 5,507,657 | 4/1996 | Seto et al. | 439/940 |

FOREIGN PATENT DOCUMENTS

| | | | |
|---|---|---|---|
| 2748818 | 11/1979 | Germany | 439/581 |

*Primary Examiner*—David L. Pirlot
*Assistant Examiner*—Tho D. Ta
*Attorney, Agent, or Firm*—Frank M. Scutch, III

[57] ABSTRACT

A support plate assembly (100) is used for aligning and/or supporting one or more accessory connector(s) (103). The support plate assembly (100) includes a support plate (101) having one or more apertures (105) for frictional engaging with a sleeve (107) of an accessory connector (103). An alignment plate (109) is attached to the support plate (101) for aligning the accessory connector (103) and for providing a working surface for placement of the support plate assembly (100) by automated machinery. The alignment plate (109) includes one or more support members (115) for engaging with the accessory connector (103) and holding the accessory connector into a fixed position.

2 Claims, 3 Drawing Sheets

ACCESSORY CONNECTOR ALIGNMENT AND SUPPORT PLATE

TECHNICAL FIELD

This invention relates in general to electrical connectors and more specifically to a means for mounting one or more electrical connectors.

BACKGROUND

Electrical connectors are typically used on personal communications products such as radios or cellular telephones in order to provide the user with a means to interface with the device. This interface often takes the form of user accessories such as speakers, remote microphones or battery charging connections. The electrical connector provides the user an easy way to fully utilize the operative features of the device.

There are a number of problems associated with the design and manufacture of one or more electrical connectors into the radio. Often the connectors are a unique shape which cannot be easily grasped by a robotic gripper or vacuum nozzle for automatic assembly onto a printed wiring board. This usually means the connectors must be hand placed and often hand soldered into the circuit. Due to the special handling and connection of these connectors, this increases the overall cost of the radio due to the extra time required for manufacture. Another problem is multiple, low cost, vendor standard connectors are preferred over a single, high cost, specialized connector. Since these connectors are typically mated with a dual plug, proper spacing between the connectors is critical for good operation. Mounting individual connectors on a printed wiring board creates a spacing and axial alignment that is dependent on the tolerances of each connector and of the holes in the printed wiring board.

Thus, the need exists for a device which can be used to easily mount one or more electrical connectors onto a printed circuit board using automated machinery allowing parts to be easily manipulated by automatic equipment for their soldering and electrical circuit connection and positioning those connectors with small tolerances with respect to one other.

DETAILED DESCRIPTION OF THE PREFERRED EMBODIMENT

Figure 1:
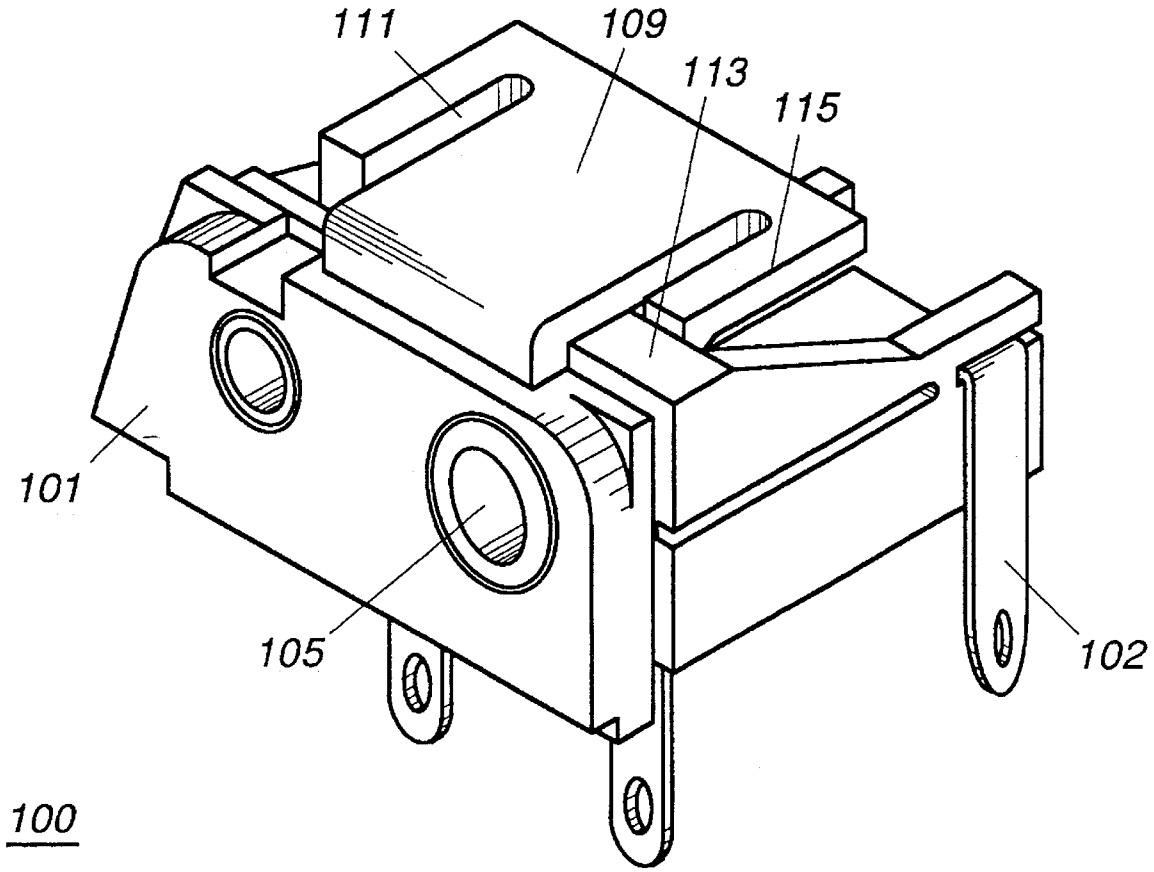
FIG. 1 is a front isometric view of the accessory connector alignment and support plate assembly and electrical connectors according to a preferred embodiment of the invention.
Figure 2:
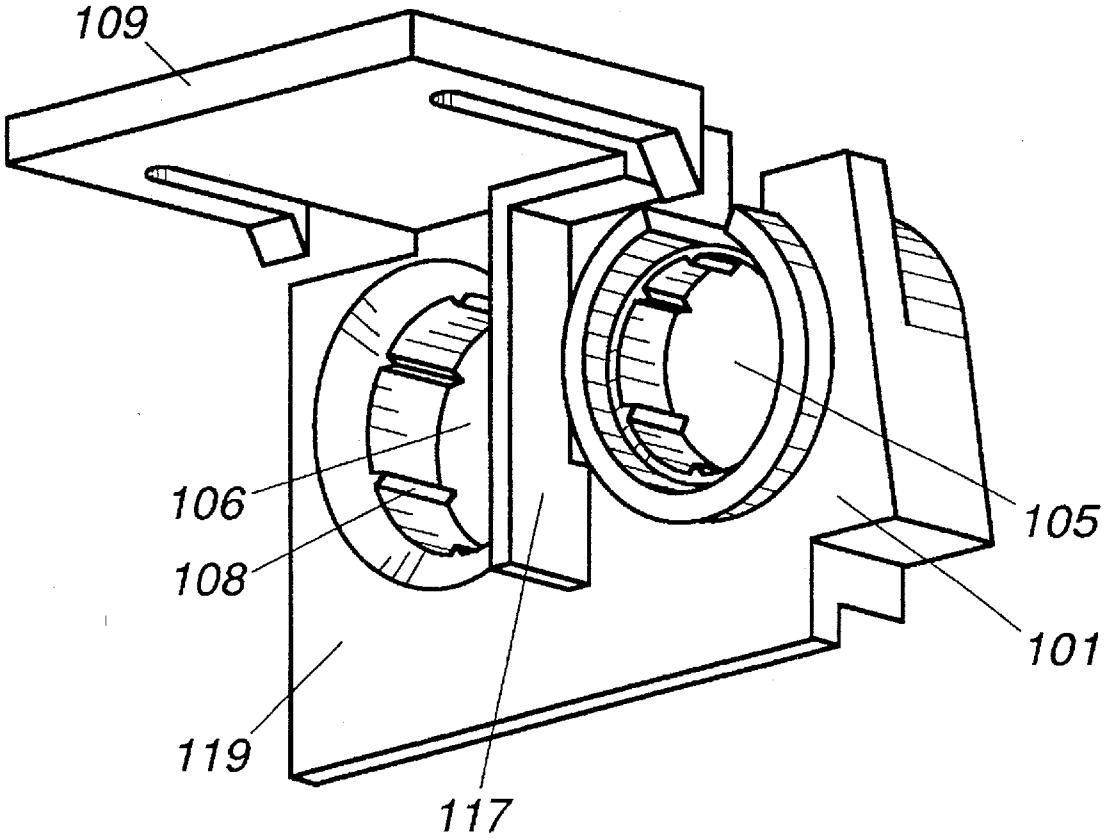
FIG. 2 is a rear isometric view of the accessory connector support plate.
Figure 3:
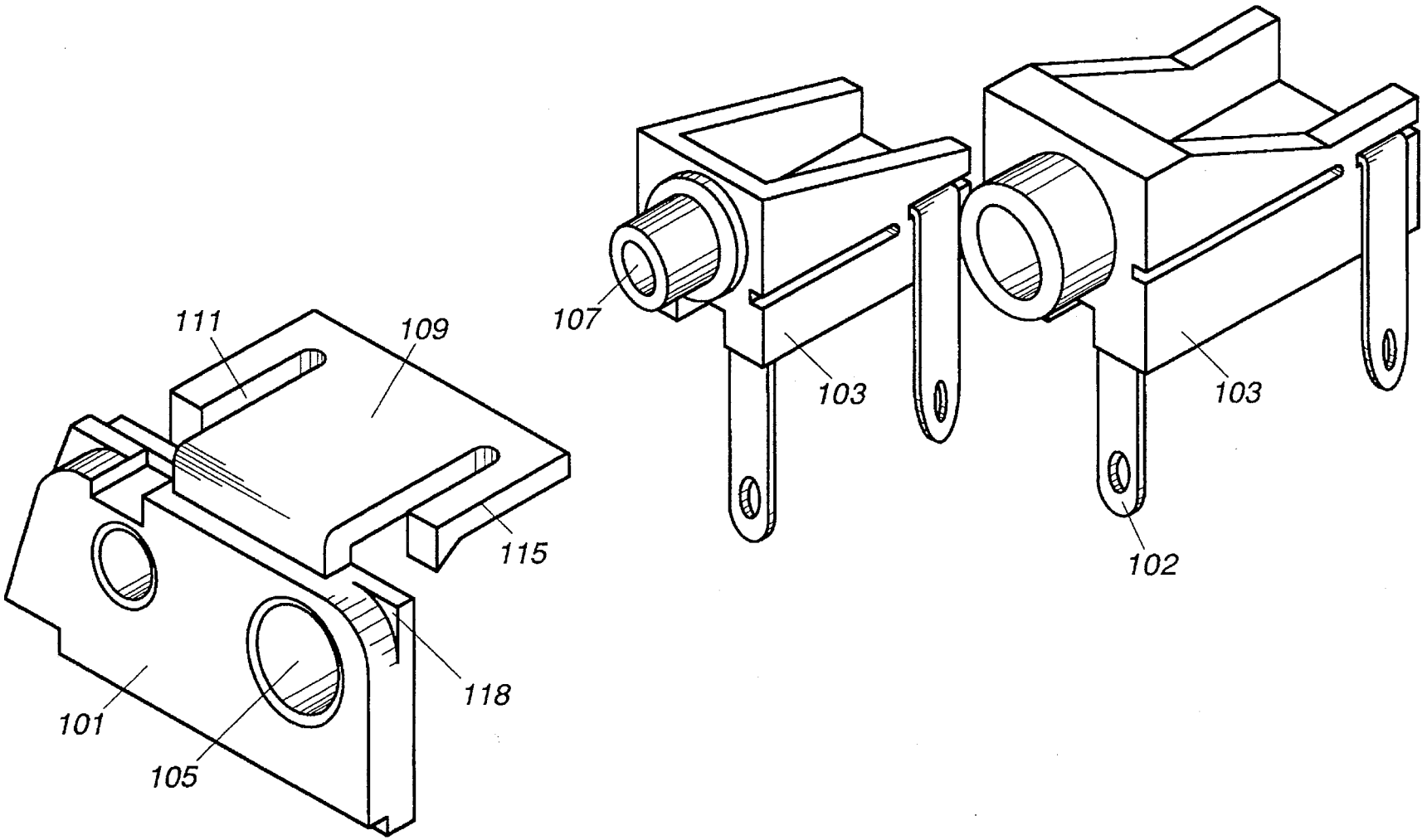
FIG. 3 is an exploded view of the support plate assembly as shown in FIG. 1.

Referring now to FIGS. 1, 2 and 3, the accessory connector alignment and support plate assembly 100 includes a support plate 101 which is used to support and mount one or more accessory connector(s) 103. Although shown as standard ⅛ inch or smaller female electrical connectors, it will be evident to those skilled in the art that the accessory connectors 103 may be of any type which are sized and/or configured to fit within the mounting aperture 105. The accessory connectors 103 include one or more electrical contacts 102 which are used for connecting the accessory connector 103 within an electrical circuit.

As best seen in FIGS. 2 and 3, a sleeve 107 of each respective electrical connector 103 frictionally engages within an aperture 105 without mechanical hardware or the like. The elimination of excess mechanical hardware, greatly facilitates the assembly process without the need for excess parts and greater cost. The apertures 105, 106 may include deformable ribs 108 which are used to provide a friction fit with the sleeve 107. The support plate 101 has a number of slots or cutout features 118 to fit against the inside of a product housing (not shown). As a load is applied through an accessory cord and its plug to the accessory connector, this load is then distributed and transferred to the product housing by the support plate 101.

At the upper portion of the support plate 101, an alignment plate 109 is attached along a side edge of the support plate 101. The alignment plate 109 is a substantially rectangular configuration and includes one or more slots 111 which form simple cantilever support members 115 the underside of the alignment plate is positioned a fixed distance from the apertures 105 such that it is used to rotationally align the body of an accessory connector 103 with the flat surface of the alignment plate 109.

As seen in FIG. 1, an upper body 113 of an accessory connector 103 makes contact and engages with a support member 115 when the accessory connector is in position. Thus, the support member 115 is positioned behind the upper body 113 of the accessory connector and prevents the accessory connector 103 from moving axially out of the aperture 105. Additionally, the alignment plate 109 provides a flat working surface so as automatic machinery or the like may be used to position the support plate assembly 100 using a vacuum tool.

As seen in FIG. 2, a rib 117 is fastened on the rear surface 119 of the support plate 101. The rib 117 attaches to the alignment plate 109 and is used to guide an accessory connector 103 into an a corresponding aperture 105. The rib 117 also provides additional support to the accessory connector 103 preventing its rotational movement when in position and providing separation between it and an adjacent accessory connector 103.

In summary, the support plate assembly provides a structure for easily mounting one or more accessory connectors within an electrical device. The support plate assembly includes one or more apparatus for engaging with a sleeve of the accessory connector and acts to assure proper alignment and spacing during the manufacturing process such as solder reflow. Additionally, the support plate assembly provides a surface for automatic placement by automated equipment so it may be manipulated using a vacuum nozzle to be precisely placed on a printed circuit board. Finally, the support plate assembly works to evenly distribute loads that may be applied through a mating plug so as to prevent unwanted stresses and material fatigue or failure.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A support plate assembly used for securing a plurality of electrical connectors to a printed circuit board comprising:

a support plate having a plurality of apertures which engage with an electrical connector, each of the plurality of apertures including at least one deformable rib for frictionally engaging with the electrical connector to hold it into a fixed position;

a top wall attached to an edge of the support plate for providing an attachment area for machinery, the top wall having a plurality of support members forming a slotted section with the top wall for engaging with each respective one of the plurality of electrical connectors to prevent axial movement of each respective electrical connector;

at least one rib attached to a surface of the support plate, between two of the plurality of apertures for preventing rotation of each one of the plurality of electrical connectors; and wherein the support plate assembly can be easily positioned by a machine onto a printed circuit board during manufacture without the need to individually mount the plurality of electrical connectors.

2. A support plate assembly for aligning and supporting at least one accessory connector comprising:

a support plate having at least one aperture;

a plurality of deformable ribs protruding from an inner surface of the at least one aperture for frictionally engaging with the at least one accessory connector to prevent rotation within the at least one aperture;

an alignment plate orthogonally attached to the support plate for aligning the at least one accessory connector and for providing a working surface for placement by automated machinery; and wherein the alignment plate includes at least one support member forming a slotted section with the alignment plate for engaging with the at least one accessory connector and holding the at least one accessory connector into a fixed position.

* * * * *